United States Patent [19]

Simpson

[11] 4,031,842

[45] June 28, 1977

[54] BOAT STEERING APPARATUS

[76] Inventor: Alden H. Simpson, 54 Pine Grove St., Springfield, Mass. 01110

[22] Filed: Apr. 26, 1976

[21] Appl. No.: 680,148

[52] U.S. Cl. ..... 114/144 C

[51] Int. Cl.[2] ..... B63H 25/52

[58] Field of Search ..... 114/144 C, 144 R

[56] References Cited

UNITED STATES PATENTS

| | | | |
|---|---|---|---|
| 3,826,213 | 7/1974 | Riebandt | 114/144 C |
| 3,880,104 | 4/1975 | Saye | 114/144 C |

FOREIGN PATENTS OR APPLICATIONS

| | | | |
|---|---|---|---|
| 1,276,567 | 6/1972 | United Kingdom | 114/144 C |

*Primary Examiner*—Trygve M. Blix
*Assistant Examiner*—Stuart M. Goldstein

[57] ABSTRACT

A wind vane and rudder combination, the vane composed of twin fins which are spaced apart and disposed at opposed angles to each other. The twin fins are supported by a beam which is gear connected to the rudder post. The pivot point of the driving gear is thus substantially inboard of the twin fins which considerably enhances the leverage required to turn the rudder as compared with that attainable by placing the vane in line with the pivot point. As a consequence increased efficiency is provided by the spaced fins; suction and turbulence is eliminated allowing a smoother flowing wind stream with minimal drag.

1 Claim, 2 Drawing Figures

BOAT STEERING APPARATUS

The invention relates to wind vanes and, in particular, to vanes in combination with related apparatus to provide self steering for sailing craft and the like.

The provision of V shaped wind vanes for wind indicators, automatic boat steering etc. is known. According to the present invention, a wind vane is designed for special adaption to self steering apparatus for a boat. In particular the vane comprises spaced and oppositely angled fins which are not only spaced from one another, but are spaced in the outboard direction from the rudder post of the boat. A spacer beam is provided which is pivotally arranged with respect to a stationary brace through which the post is extended, the beam being in driving connection with the steering components of the boat. Efficiency in operation of the steering apparatus especially in terms of enhanced leverage is thereby gained. Such efficiency is further enhanced by the provision of a gearing drive between the beam and post.

Figure 1:
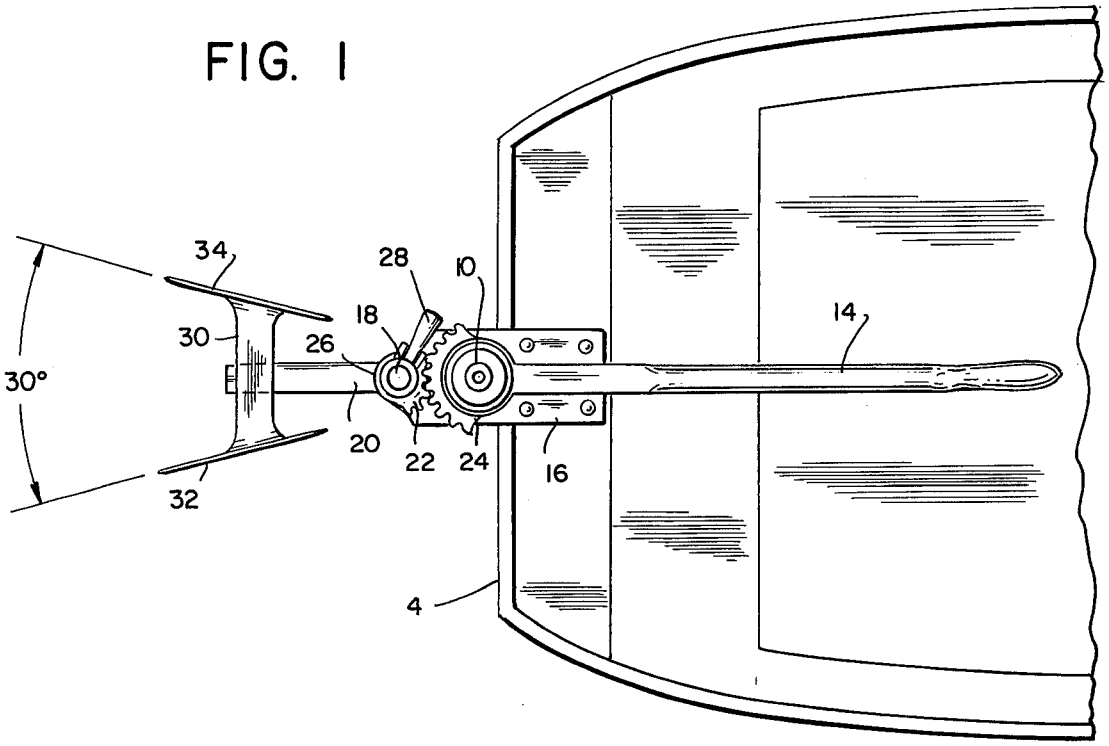

One object of the invention is to provide a more efficient self steering apparatus for a boat which includes spaced and opposing fins outboard of the conventional components employed to direct the boat when underway. Other objects and advantages of the invention may be appreciated on reading the following description of one embodiment thereof which is taken in conjunction with the accompanying drawings, in which:

FIG. 1 is a top view of the new and improved self steering apparatus; and

Figure 2:
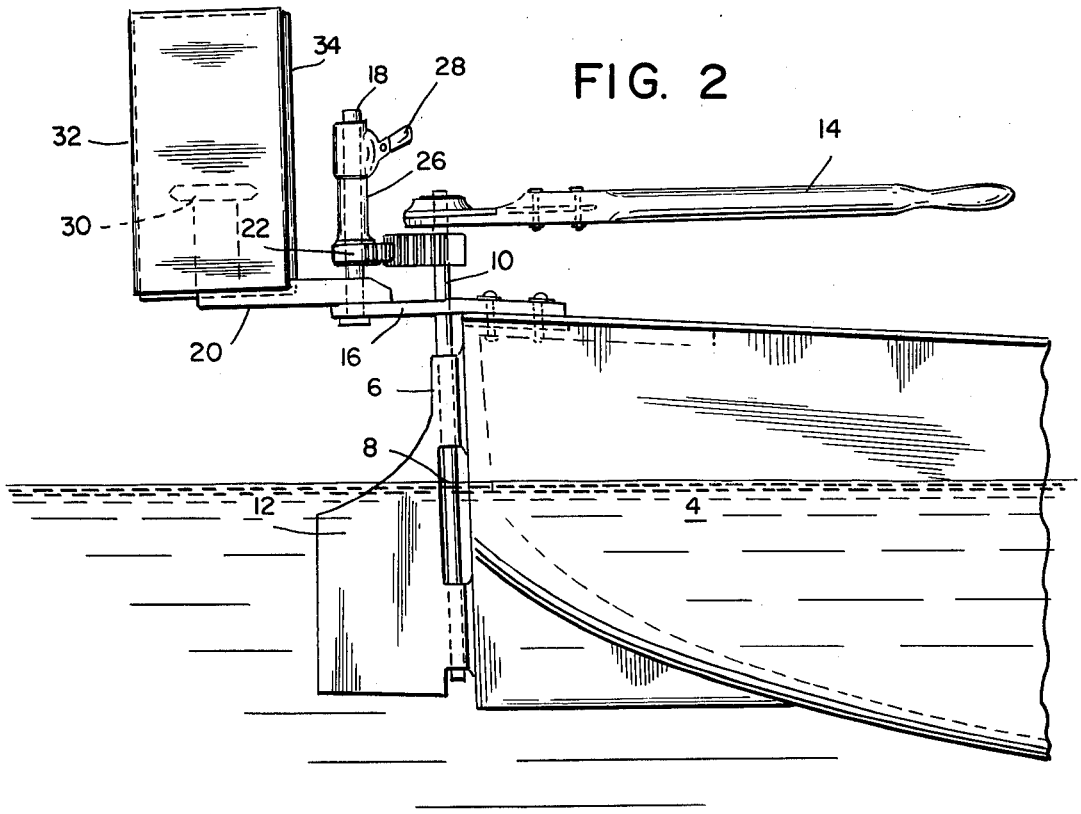

FIG. 2 is a side elevation of same. Referring to the drawings there is secured to the transom of boat 4 a pair of brackets 6 and 8 through which rudder post 10 is extended, the post being integrally attached to rudder 12. Mounted atop the post 10 is a conventional tiller 14.

Extending outboard of the boat from its stern is stationary support member 16 through which the post 10 extends. Shaft 18 extends through the member 16 and spacer beam 20 is pivotally mounted on the shaft. Mounted on the shaft 18 is gear 22 which is in engagement with gear 24 mounted on the rudder post 10. Sleeve 26 is utilized to maintain gear 22 on the shaft 18 being held in place on the shaft by lock member 28.

Outboard of the boat and secured to the free end of the beam 20 is cross member 30 at each end of which is attached a fin 32 and 34. The fins are set at approximately 15 degrees at opposing angles relative to the beam 20.

It is seen that in operation change of wind will create a differential force on the two fins actually producing a positive force on the outer surface of one fin while creating a zero force on the outer surface of the other. The resultant force causes the beam 20 to exert a leverage on shaft 18 to actuate the gear train and the rudder post 10. Such leverage is effected without turbulence, drag and suction which would occur if a conventional V shaped pair of fins had been employed.

Various modifications of the invention may be effected by persons skilled in the art without departing from the scope and principle of the invention as defined in the appended claims.

I claim:

1. A self steering apparatus for a sailing craft and the like comprising a rudder and rudder post, a tiller mounted on said post for guiding said rudder, a stationary support member extending rearwardly and outboard of said craft through which said rudder post extends, a shaft extending through the support member, a beam mounted on said support and said shaft and being pivotal on the shaft, said shaft being in geared connection with said rudder post as an alternative guide for said rudder, and a pair of spaced fins secured to the pivotal beam respectively on opposed sides thereof and being forwardly and inwardly inclined to one another whereby said beam is moved in accordance with the relative wind forces on each side of the fins.

* * * * *